US005185942A

United States Patent [19]

Decker

[11] Patent Number: 5,185,942

[45] Date of Patent: Feb. 16, 1993

[54] LOTION CONTAINER APPARATUS

[76] Inventor: Patrick A. Decker, 3219 Shady Valley, Manhattan, Kans. 66502

[21] Appl. No.: 797,368

[22] Filed: Nov. 25, 1991

[51] Int. Cl.[5] ..... A43B 3/00; A43B 3/12

[52] U.S. Cl. ..... 36/11.5; 36/1; 36/29

[58] Field of Search ..... 36/1, 11.5, 28, 29; 220/352, 375; 215/306, 356; 383/3, 96

[56] References Cited

U.S. PATENT DOCUMENTS

| | | | |
|---|---|---|---|
| 3,031,111 | 4/1962 | Stull | 220/375 |
| 3,120,712 | 2/1964 | Menken | 36/29 |
| 4,172,330 | 10/1979 | Kao | 36/11.5 |
| 4,217,705 | 8/1980 | Donzis | 36/29 |
| 4,439,935 | 4/1984 | Kelly | 36/11.5 |
| 4,618,994 | 10/1986 | Bishop | 383/96 |
| 4,686,781 | 8/1987 | Bury | 36/11.5 |

*Primary Examiner*—Paul T. Sewell
*Assistant Examiner*—Marie D. Patterson
*Attorney, Agent, or Firm*—Leon Gilden

[57] ABSTRACT

The apparatus is arranged to provide for a lotion container contained within an upper and lower shoe sole portion, wherein the sole portion includes supporting bands for mounting the container to an individual's foot. Confronting and mirror image cavities within the upper and lower sole portions receive a fluid bladder therewithin. A modification of the invention includes the upper and lower sole portion separable relative to one another to permit selective replacement of the fluid bladder.

2 Claims, 4 Drawing Sheets

LOTION CONTAINER APPARATUS

BACKGROUND OF THE INVENTION

1. Field of the Invention

The field of invention relates to container apparatus, and more particularly pertains to a new and improved lotion container apparatus wherein the same is arranged to provide convenience of transport of lotion and the like relative to a recreation area such as an ocean beach or the like.

2. Description of the Prior Art

Various container structure has been utilized in the prior art for the mounting and securement of lotion and the like for use in particularly beach environments, due to the requisite need for protection of the container structure, as well as maintaining its ease of transport due to the traversing of such distances from typical parking areas to the water front. The instant invention attempts to provide for a container configured to be utilized as a shoe permitting ease of transport of the container to afford its protection and convenience in use.

Prior art shoe apparatus is available in the prior art to utilize various chambers within a shoe, typically for the cushioning during walking, and such is exemplified in U.S. Pat. No. 4,567,677 to Zona wherein a water-filled shoe insole is provided, wherein the insole is formed with a fluid chamber structure.

U.S. Pat. No. 4,856,208 to Zaccaro wherein the shoe sole includes inflatable passages of pneumatic chambers contained within the sole structure.

U.S. Pat. No. 4,934,070 to Mauger sets forth a shoe sole including a circulating fluid contained therewithin.

As such, it may be appreciated that there continues to be a need for a new and improved lotion container apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of container apparatus now present in the prior art, the present invention provides a lotion container apparatus wherein the same is arranged for use as a shoe member in its transport relative to remote orientations by a user thereof. As such, the general purpose of the present invention, which will be described subsequently in greater detail, is to provide a new and improved lotion container apparatus which has all the advantages of the prior art container apparatus and none of the disadvantages.

To attain this, the present invention provides an apparatus arranged for a lotion container contained within an upper and lower shoe sole portion, wherein the sole portion includes supporting bands for mounting the container to an individual's foot. Confronting and mirror image cavities within the upper and lower sole portions receive a fluid bladder therewithin. A modification of the invention includes the upper and lower sole portion separable relative to one another to permit selective replacement of the fluid bladder.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved lotion container apparatus which has all the advantages of the prior art container apparatus and none of the disadvantages.

It is another object of the present invention to provide a new and improved lotion container apparatus which may be easily and efficiently manufactured and marketed.

It is a further object of the present invention to provide a new and improved lotion container apparatus which is of a durable and reliable construction.

An even further object of the present invention is to provide a new and improved lotion container apparatus which is susceptible of a low cost of manufacture with regard to both materials and labor, and which accordingly is then susceptible of low prices of sale to the consuming public, thereby making such lotion container apparatus economically available to the buying public.

Still yet another object of the present invention is to provide a new and improved lotion container apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
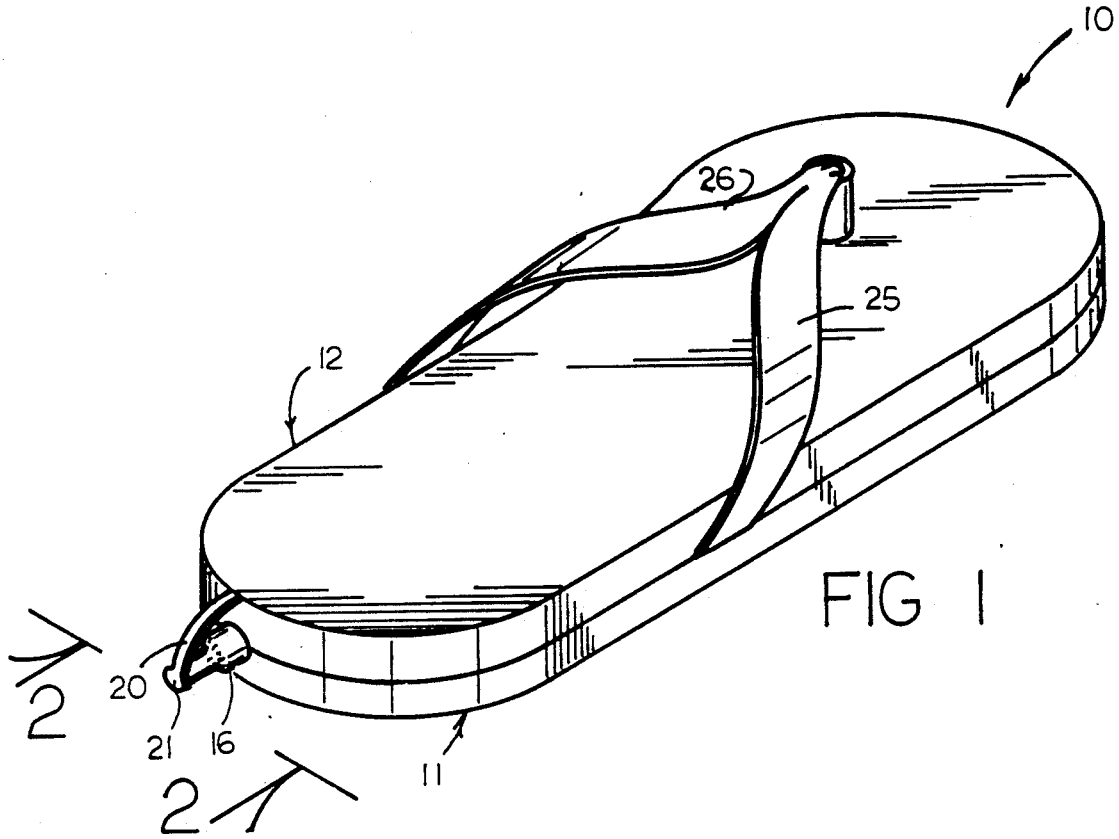
FIG. 1 is an isometric illustration of the instant invention.
Figure 2:
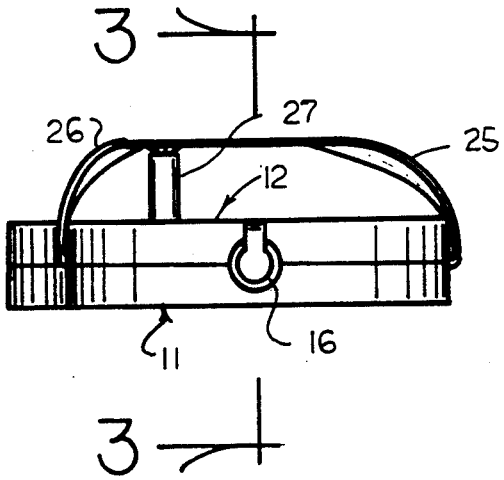
FIG. 2 is an orthographic view, taken along the lines 2—2 of FIG. 1 in the direction indicated by the arrows.
Figure 3:
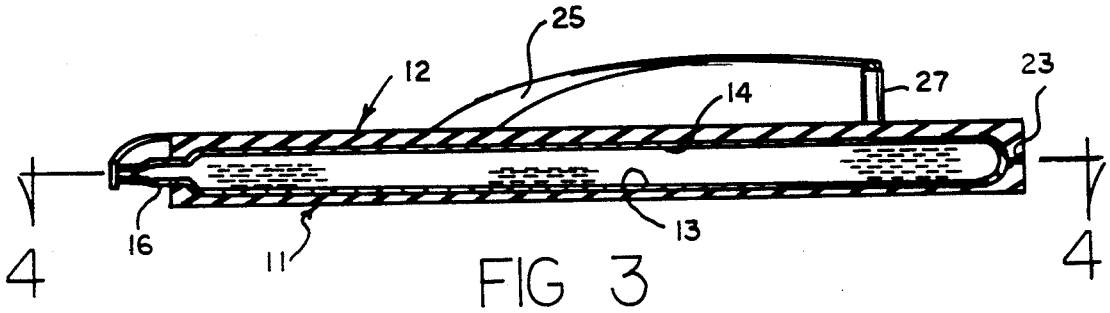
FIG. 3 is an orthographic view, taken along the lines 3—3 of FIG. 2 in the direction indicated by the arrows.
Figure 4:
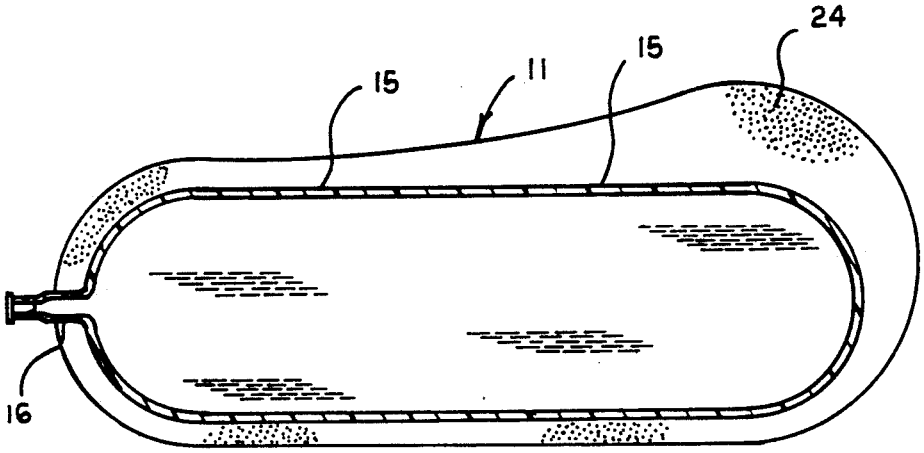
FIG. 4 is an orthographic view, taken along the lines 4—4 of FIG. 3 in the direction indicated by the arrows.
Figure 5:
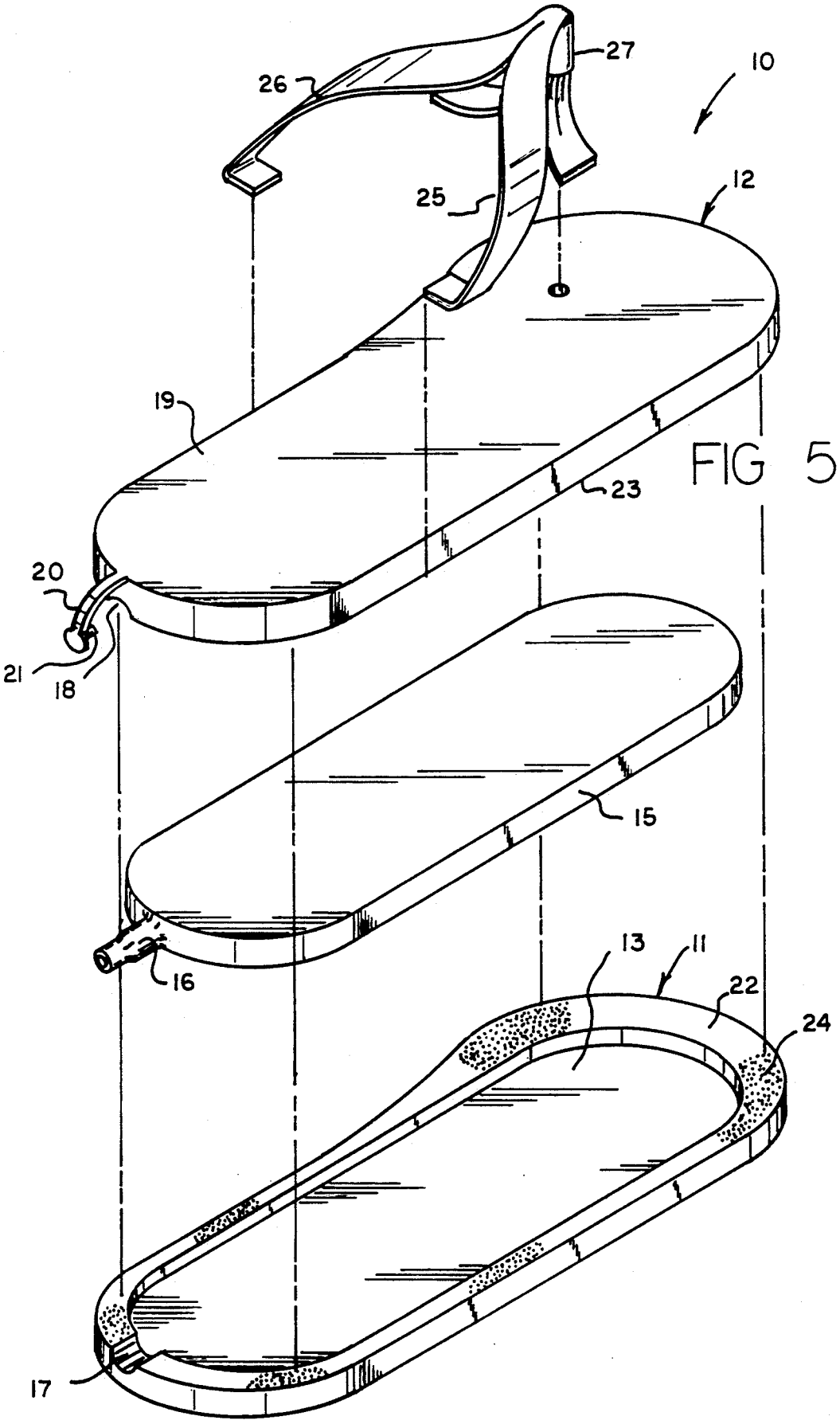
FIG. 5 is an isometric exploded illustration of the invention.

With reference now to the drawings, and in particular to FIGS. 1 to 6 thereof, a new and improved lotion container apparatus embodying the principles and concepts of the present invention and generally designated by the reference numerals 10 and 10*a* will be described.

More specifically, the lotion container apparatus 10 of the instant invention essentially comprises a lower resilient sole plate 11 in mating and confronting relationship to an upper resilient sole plate 12 that are in a contiguous coextensive relationship relative to one another, as exemplified in the FIG. 1 for example. The lower sole plate includes a lower sole plate cavity 13 in confrontation and in contiguous communication to a mirror image upper sole plate cavity 14 housing a fluid bladder 15 therewithin. The fluid bladder 15 includes a fluid bladder nozzle 16 that is directed through a respective lower and upper sole plate groove 17 and 18 that are in a coextensive relationship relative to one another communicating the respective lower and upper cavities 13 and 14 through the respective lower and upper plates 11 and 12, wherein each lower and upper groove are of a generally semi-cylindrical configuration. A flexible support tether 20 formed of a resilient shape retentive material is mounted to the upper sole plate 11 adjacent the upper sole plate top surface 19 and is formed with a cylindrical nozzle plug 21 that is received within the respective fluid bladder nozzle 16. The upper sole plate 12 includes an upper sole plate bottom surface 23 in contiguous communicating with a lower sole plate top surface 22, with selectively an adhesive 25 securing the top and bottom surfaces 22 and 23 together. The use of respective first and second lateral containment band 25 and 26 are mounted to opposed sides of the upper sole plate above the top surface 19 and secured to a forward mounting boss 27 that is generally orthogonally oriented relative to the top surface 19.

Figure 6:
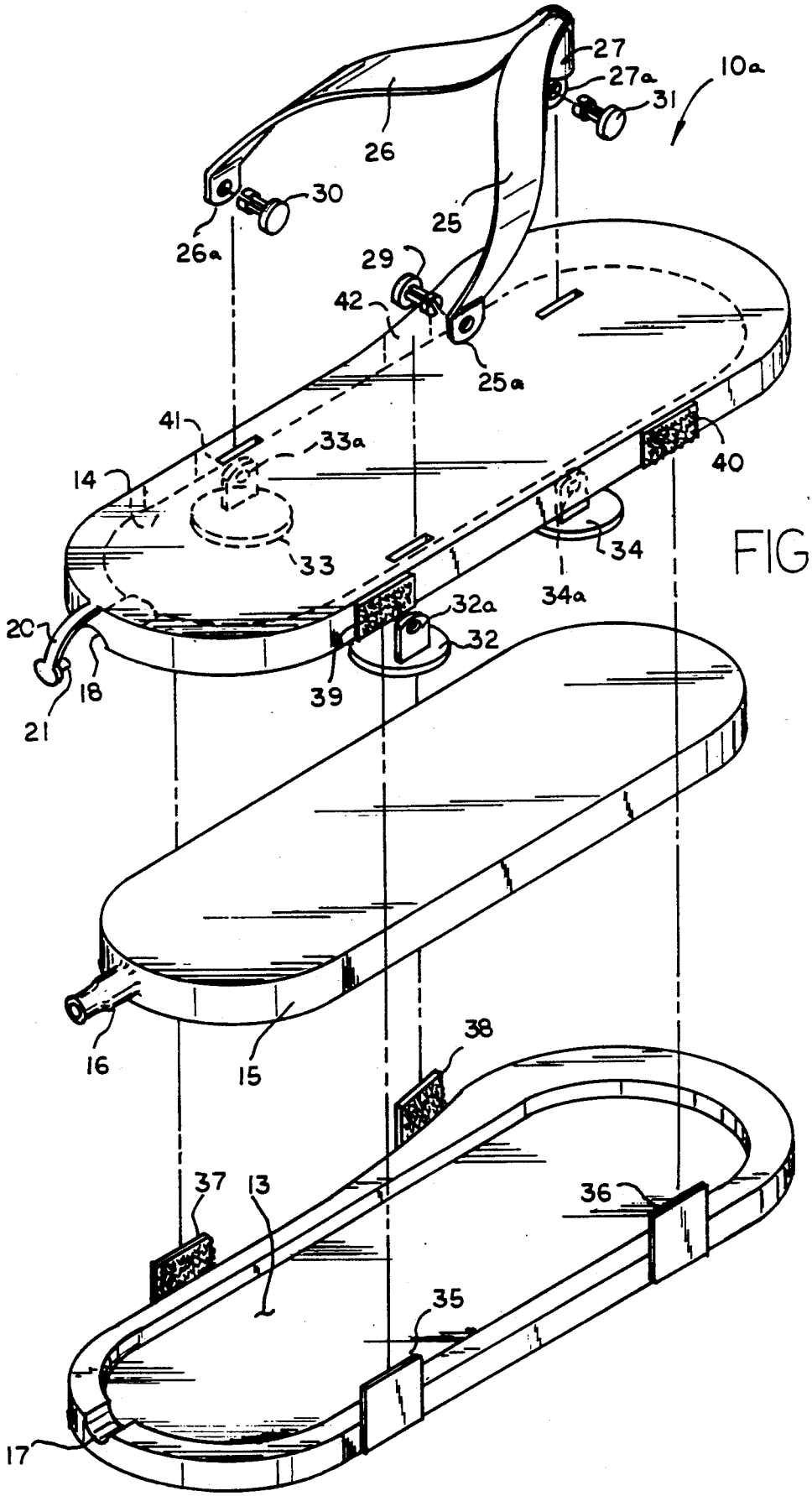
FIG. 6 is an isometric exploded illustration of a modification of the invention.

The FIG. 6 illustrates a modified apparatus 10*a*, wherein the lower sole plate 11 and the upper sole plate 12 are secured together in a releasable manner to permit selective replacement of the bladder 15 by various bladders of various types of lotion, such as oils and the like.

The first lateral containment band includes a first flange 25*a*, with a first bore directed therethrough, the second lateral containment band includes a second flange 26*a* with a second bore directed therethrough, and the forward mounting boss 27 includes a third flange 27*a* formed with a third bore, wherein each flange is formed to a lower terminal end of the respective bands 25, 26, and the boss 27. Each of the first, second, and third flanges 25*a*, 26*a*, and 27*a* are directed through associated first, second, and third associated and respective slots in communication with the upper sole plate cavity 14. A respective first, second, and third anchor plate 32, 33, and 34 include respective first, second, and third anchor plate flanges 32*a*, 33*a*, and 34*a* each including respective anchor flange bore to receive a respective first, second, and third lock pin 29, 30, and 31 therethrough as the projection of the anchor plate flanges 32*a*, 33*a*, and 34*a* are projected through the first, second, and third slots as illustrated to position the anchor pins above the top surface 19 opposed to directing the anchor pins into the cavity 14 in the absence of use of the anchor plates 32, 33, and 34.

A respective first, second, third, and fourth hook and loop fastener strap 35, 36, 37, and 38 are mounted to a side surface of the lower sole plate 11 projecting upwardly thereof for respective and selective interlocking with a respective first, second, third, and fourth hook and loop fastener patch 39, 40, 41, and 42 mounted to a side wall of the upper sole plate 12.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A lotion container apparatus for transport and selective mounting to an individual's foot, wherein the apparatus comprises, a lower resilient sole plate secured to an upper resilient sole plate, the upper resilient sole plate including an upper sole plate cavity, the lower resilient sole plate including a lower sole plate cavity, wherein the lower sole plate cavity and the upper sole cavity are in confronting coextensive relationship relative to one another, and the lower sole plate and the upper sole plate are in a contiguous and coextensive relationship relative to one another, and a fluid bladder mounted coextensively within the lower sole plate cavity and the upper sole plate cavity when the lower sole plate and the upper sole plate are in contiguous communication relative to one another, and the lower sole plate including a lower groove directed through the top surface of the lower sole plate and the upper sole plate including an upper groove directed through a bottom surface of the upper sole plate, wherein the lower groove and the upper groove are in a coextensive confronting relationship relative to one another and the lower sole plate groove and the upper sole plate groove are each formed of a semi-cylindrical configuration, and the fluid bladder includes a nozzle in fluid communication with the bladder and extending from the fluid bladder through the lower sole plate groove and the upper sole plate groove exteriorly of the lower sole plate and the upper sole plate, and the upper sole plate includes an upper sole plate top surface, and a flexible support tether of a resilient shape retentent material is mounted to the upper sole plate adjacent the upper groove between the upper groove and the upper sole plate top surface, with a cylindrical nozzle plug mounted to a forward distal end of the support tether, wherein the nozzle plug is arranged for selective projection within the nozzle, and the lower sole plate includes a lower sole plate side wall, and the upper sole plate includes an upper sole plate side wall, and the lower sole plate side wall includes a plurality of hook and loop fastener straps, including at least a first and second hook and loop fastener strap mounted to the lower sole plate side wall extending upwardly thereof, and the upper sole plate including an upper sole plate side wall and the upper sole plate side wall including at least a first and second hook and loop fastener patch for selective securement to the first and second hook and loop fastener.

2. An apparatus as set forth in claim 1 further including a first and second lateral containment band joined together, wherein the first lateral containment band includes a first flange mounted at a lower terminal end of the first containment band, and the second lateral containment includes a second flange mounted to a lower terminal end of the second containment band, and the upper sole plate includes a first slot and a second slot, and the first flange includes a first bore, the second flange includes a second bore, and a first anchor plate includes a first anchor plate flange projecting through the first slot, and the second slot includes a second anchor plate, with a second anchor plate flange projecting through the second slot, and a first lock pin is projected through the first anchor plate flange and the first bore, and the second lock pin is projected through the second anchor plate flange and the second bore, and the first lateral containment band and the second lateral containment band are mounted to a forward mounting boss oriented forwardly of the first lateral containment band and the second lateral containment band, with the forward mounting boss including a third flange including a third bore, and a third anchor plate including a third anchor plate flange, and a third slot is projected through the upper sole plate projecting through the upper sole plate top surface receiving the third anchor plate flange therethrough, and a third lock pin directed through the third anchor plate flange and the third bore, and wherein the forward mounting boss is oriented generally orthogonally relative to the upper sole plate top surface permitting reception of an individual's foot portion between the first lateral containment band and the second lateral containment band, with the forward mounting boss forming an abutment for said foot.

* * * * *